US012352170B2

(12) United States Patent
Grothen et al.

(10) Patent No.: US 12,352,170 B2
(45) Date of Patent: Jul. 8, 2025

(54) TUNNEL BORING MACHINE FOR EXCAVATING SEMICIRCULAR-ARCHED TUNNELS

(71) Applicant: ROBBINS MINING, INC., Solon, OH (US)

(72) Inventors: Bradley Dean Grothen, Renton, WA (US); Jay Michael McNeeley, Maple Valley, WA (US); Stephen Mitchell Smading, Renton, WA (US)

(73) Assignee: Robbins Mining, Inc., Solon, OH (US)

( * ) Notice: Subject to any disclaimer, the term of this patent is extended or adjusted under 35 U.S.C. 154(b) by 0 days.

(21) Appl. No.: 18/424,649

(22) Filed: Jan. 26, 2024

(65) Prior Publication Data

US 2024/0254879 A1 Aug. 1, 2024

Related U.S. Application Data

(60) Provisional application No. 63/482,011, filed on Jan. 27, 2023.

(51) Int. Cl.
*E21D 9/11* (2006.01)
*E21D 9/12* (2006.01)

(52) U.S. Cl.
CPC ..... *E21D 9/112* (2013.01); *E21D 9/12* (2013.01)

(58) Field of Classification Search
CPC ..... E21D 9/03; E21D 9/113; E21D 9/116; E21D 9/118; E21D 9/01; E21D 9/087; E21D 9/1013; E21D 9/112; E21D 9/12
See application file for complete search history.

(56) References Cited

U.S. PATENT DOCUMENTS

| | | | |
|---|---|---|---|
| 3,428,363 | A | 2/1969 | Drescher et al. |
| 3,643,998 | A | 2/1972 | Williamson |
| 3,963,080 | A | 6/1976 | Walker |
| 4,185,873 | A | 1/1980 | Bohnes et al. |
| 5,110,188 | A | 5/1992 | Kawai et al. |

(Continued)

FOREIGN PATENT DOCUMENTS

| | | | |
|---|---|---|---|
| CN | 108625869 | A * | 10/2018 |
| CN | 212454426 | U * | 2/2021 |

(Continued)

OTHER PUBLICATIONS

English Translation of CN-11457867 (Year: 2022).*

(Continued)

*Primary Examiner* — Janine M Kreck
(74) *Attorney, Agent, or Firm* — Christensen O'Connor Johnson Kindness PLLC

(57) ABSTRACT

A Tunnel Boring Machine (TBM) with a circular cutting profile includes secondary cutterhead components that produce a semicircular-arched tunnel profile for use in underground mining and/or civil construction operations, e.g., for boring in material containing rocks with Unconfined Compressive Strength (UCS) of up to 200 MPA or stronger. The machine is particularly suited to excavate long access tunnels, mine development drifts, road tunnels, and other types of tunnels that require flat bottom, semicircular-arched profiles. The substantially flat tunnel floor allows immediate and effective use of standard vehicles for material and crew transport as well as other construction and mining activities.

20 Claims, 9 Drawing Sheets

(56) References Cited

U.S. PATENT DOCUMENTS

| | | | | |
|---|---|---|---|---|
| 10,539,016 | B2 | 1/2020 | Su et al. | |
| 2009/0309409 | A1 * | 12/2009 | Kogler | E21D 9/113 299/33 |

FOREIGN PATENT DOCUMENTS

| | | | | |
|---|---|---|---|---|
| CN | 112727483 | A | * | 4/2021 |
| CN | 114562283 | A | * | 5/2022 |
| CN | 114575867 | A | * | 6/2022 |
| DE | 3121244 | A1 | | 12/1982 |
| WO | WO-2007075149 | A1 | * | 7/2007 |
| WO | 2012/058706 | A2 | | 5/2012 |

OTHER PUBLICATIONS

International Search Report and Written Opinion mailed May 16, 2024, issued in corresponding International Application No. PCT/US2024/013249, filed Jan. 26, 2024, 8 pages.

* cited by examiner

TUNNEL BORING MACHINE FOR EXCAVATING SEMICIRCULAR-ARCHED TUNNELS

CROSS-REFERENCE TO RELATED APPLICATION

This application claims the benefit of Provisional Application No. 63/482,011, filed Jan. 27, 2023, the disclosure of which is hereby incorporated by reference herein in its entirety for all purposes.

BACKGROUND

Tunnel boring machines (TBMs) for excavating tunnels are known in the art. For example, U.S. Pat. No. 7,832,960, to Home et al., which is hereby incorporated by reference, discloses a tunnel boring machine having a cutterhead, a main support beam, a first, second, and third shield; and a ground conditioning work zone within the first shield, a gripper assembly, a segment erector arm for lining the tunnel, and at least one propulsion mechanism. The propulsion mechanism moves the cutterhead and the first and the second shield forward, while the third shield and the gripper assembly remain stationary. In U.S. Pat. No. 9,010,872, to Lenaburg, which is hereby incorporated by reference, a TBM is disclosed that has a cutterhead assembly rotatably mounted to a forward shield assembly through a cutterhead support assembly. The cutterhead support assembly receives a variable number of drive assemblies. The cutterhead support structure includes a housing portion that houses the main bearing assembly and a drive gear. A plurality of drive mount stations provide access to the drive gear.

The TBMs described in the above references are configured to bore a tunnel having a generally circular cross section. The curved tunnel crown of the circular cross section is advantageous to increase rock stability, reducing the need for ground support during tunnel construction. However, the curved tunnel floor of the circular cross section cannot be traversed by standard vehicles (e.g., trucks, trailers, rail cars, and other machinery) without first constructing a substantially flat invert (with invert segments, poured concrete, etc.) for travel by the standard vehicles.

TBMs can be configured with auxiliary cutter heads to bore tunnel having non-circular cross sections. For example, U.S. Pat. No. 5,110,188, to Kawai et al., which is hereby incorporated by reference, discloses a TBM with a plurality of circular cutters and one or more rocking cutters configured to bore a tunnel having a non-circular cross section. U.S. Pat. No. 10,539,016, to Su et al., which is hereby incorporated by reference, discloses a TBM having a main cutterhead assembly and a plurality of auxiliary cutterheads configured to excavate a tunnel having a non-circular cross section, where the main cutterhead assembly is configured to be movable vertically with respect to the auxiliary cutterheads.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1A:
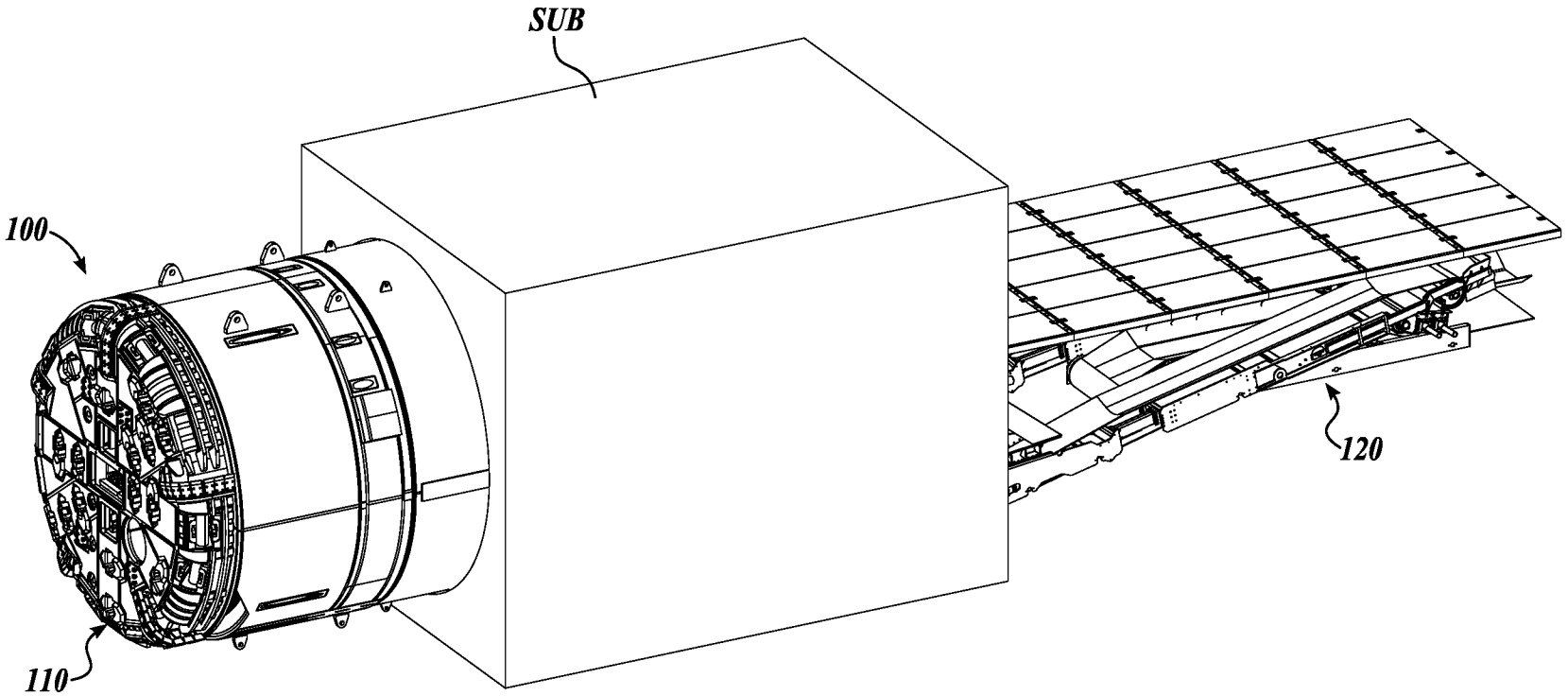
FIGS. 1A and 1B are perspective views of a tunnel boring machine (TBM) in accordance with aspects of the present disclosure, with the TBM boring a semicircular-arched tunnel through a representative portion of tunneling substrate.

The detailed description set forth herein connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

As will be described in more detail below, the present disclosure provides examples of a tunnel boring machine (TBM) configured to excavate a tunnel having a round arched top surface, substantially vertical sidewalls, and a substantially flat bottom surface (referred to herein as having the following tunnel shapes: "semicircular-arched," "stilted-semicircular-arched," "round-arched," "horseshoe," "U," etc.). Embodiments of the TBMs of the present disclosure can be referred to herein as a "12% TBM," which represents the approximately 12% additional tunnel boring excavation performed by the secondary cutterheads to create the substantially vertical sidewalls and flat bottom surface.

Embodiments of the 12% TBM described herein are expected to have several benefits over conventional TBMs. For example, most mining operations and many civil construction projects require flat-bottomed tunnel profiles to facilitate transportation of material, crew, and other necessities by standard vehicles (e.g., trucks, trailers, railcars, and other machinery). Conventional TBMs produce circular tunnel cross sections; however, TBMs of the present disclosure can excavate the remaining 12% of the tunnel using the same machinery as the primary boring operations, avoiding additional construction processes to prepare the tunnel for travel by standard vehicles. In creating the semicircular-arched tunnel, TBMs are a more efficient and productive method of tunnel excavation when compared with other conventional methods, such as drill and blast methods, backfilling the bottom of the round tunnel, or other mechanical methods (e.g., roadheaders).

The semicircular-arched tunnel profile created by the 12% TBMs of the present disclosure provide a semicircular-arched crown for natural support of the tunnel ceiling, with vertical sidewalls and a flat bottom that is ideal for transportation by standard vehicles. By using the same machinery as the primary boring operations, TBMs of the present disclosure can avoid frequent disruptions of other activities, such as excavation of the 12% of the tunnel by drilling and blasting, which is especially critical in mines which are sensitive to any interruption in ore extraction. Creating the semicircular-arched tunnel profile during primary boring operations also streamlines decommissioning, dis-assembly, retrieval, and demobilization of the site after tunnel boring operations are complete.

Although embodiments of the present disclosure may be described with reference to a configuration of a TBM suitable for producing semicircular-arched tunnel profiles, including the configurations shown in the FIGURES, one skilled in the relevant art will appreciate that the disclosed embodiments are illustrative in nature and therefore should not be construed as limited to such an application. It should therefore be apparent that the disclosed technologies and methodologies have wide application, and therefore may be suitable for use with many types of applications. Accordingly, the following descriptions and illustrations herein should not limit the scope of the claimed subject matter.

In accordance with one aspect of the present invention TBM for boring a semicircular-arched tunnel having a tunnel wall is provided. The TBM can include a main cutterhead assembly rotatably coupled to a front end of a cutterhead support on a main support beam, wherein the main cutterhead assembly is configured to rotate with respect to the cutterhead support about a primary axis that is aligned with a centerline of a semicircular portion of the tunnel; a plurality of gripper assemblies located rearward of the main cutterhead assembly, cutterhead support/forward shield, the gripper assemblies being configured to move between: a retracted position in which the gripper assemblies do not engage the tunnel wall; and an extended position wherein the gripper assemblies engage the tunnel wall to impart axial movement on the main cutterhead and to react to the boring forces of the tunnel boring machine. The TBM can further include a pair of secondary cutterhead assemblies slidably mounted to and disposed on opposite sides of the main support beam, wherein each of the pair of secondary cutter wheel assemblies have a carrier operably coupled to a drive system configured to rotate the secondary cutterhead assemblies about a secondary axis perpendicular to the primary axis; and at least one thrust cylinder configured to urge the pair of secondary cutterhead assemblies forwardly with respect to the main support beam independently of the main cutterhead assembly. In other embodiments, the main support beam of the TBM can have an upper portion aligned with the primary axis of the main cutterhead assembly, and a lower portion defining an elongate slot parallel to the main support beam, wherein the pair of secondary cutterhead assemblies engage the elongate slots to permit the secondary cutterhead assemblies to move longitudinally with respect to the main cutterhead assembly.

Figure 1B:
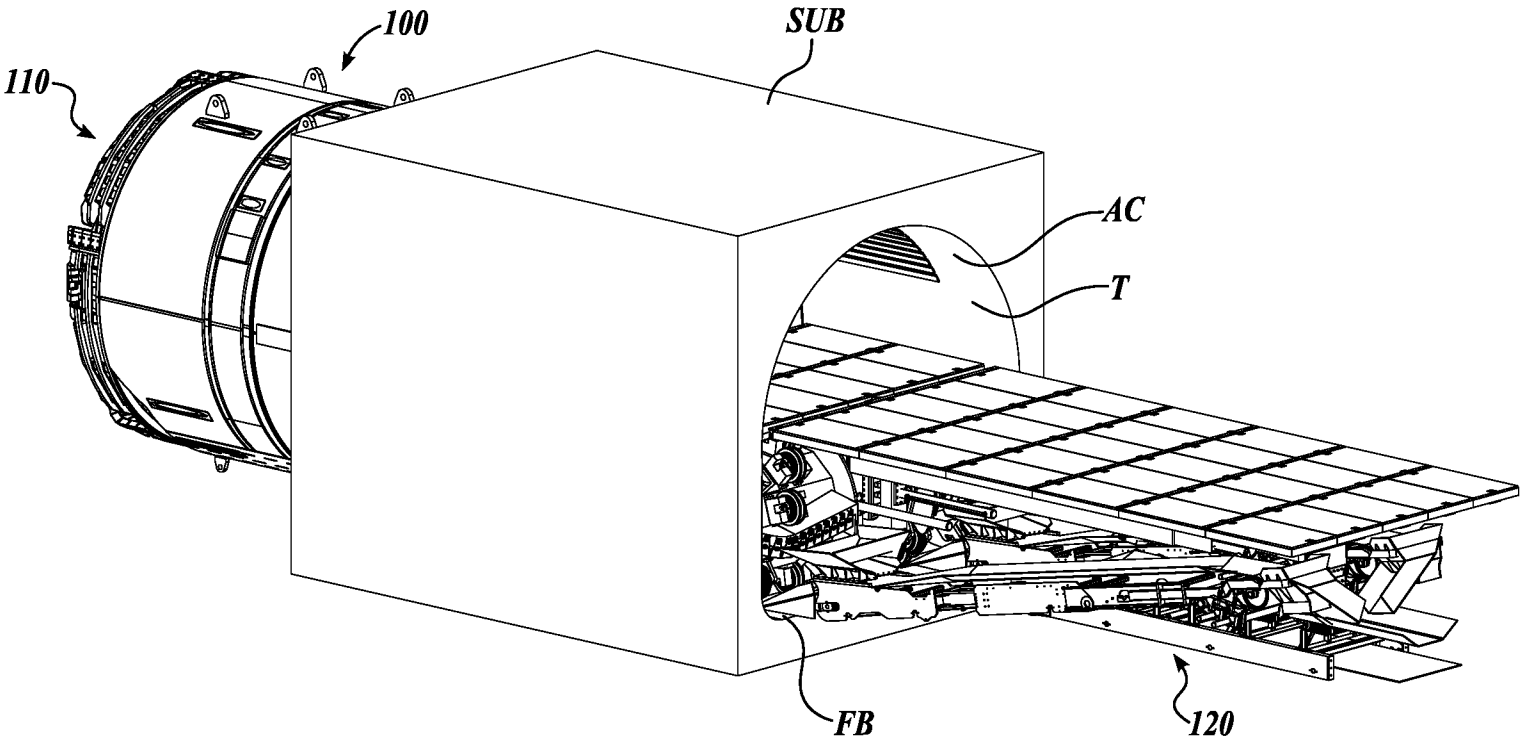

FIGS. 1A and 1B are perspective views of a 12% TBM assembly 100 ("TBM 100") in accordance with aspects of the present disclosure, shown in FIGS. 1A and 1B with the TBM 100 boring a semicircular-arched tunnel T through a representative portion of tunneling substrate SUB (e.g., soft, medium, or hard rock, or other friable material, etc.). The TBM 100 includes a main cutterhead assembly 110 ("main cutterhead 110") and a conveyor system 120 shown on either side of the tunneling substrate SUB. As shown in FIG. 1B (and FIG. 3, described below) the tunnel T can include a semicircular-arched crown portion AC for natural support of the tunnel ceiling, vertical sidewalls SW, and a substantially flat bottom FB that is ideal for transportation by standard vehicles. Embodiments of the TBM 100 can excavate about 88% of the tunnel face with the main cutterhead 110 and the remaining 12% is excavated by two secondary cutterheads (or "cutting wheels"), which will be described in detail below and are located aft of, and outboard of, the main cutterhead 110. The secondary cutterheads remove about an additional 12% of the tunnel cross sectional area, hence the reference to "12% TBM." In other embodiments, the secondary cutterheads can remove less than or greater than 12% of the tunnel cross sectional area with respect to the main cutterhead excavation area.

Figure 2A:
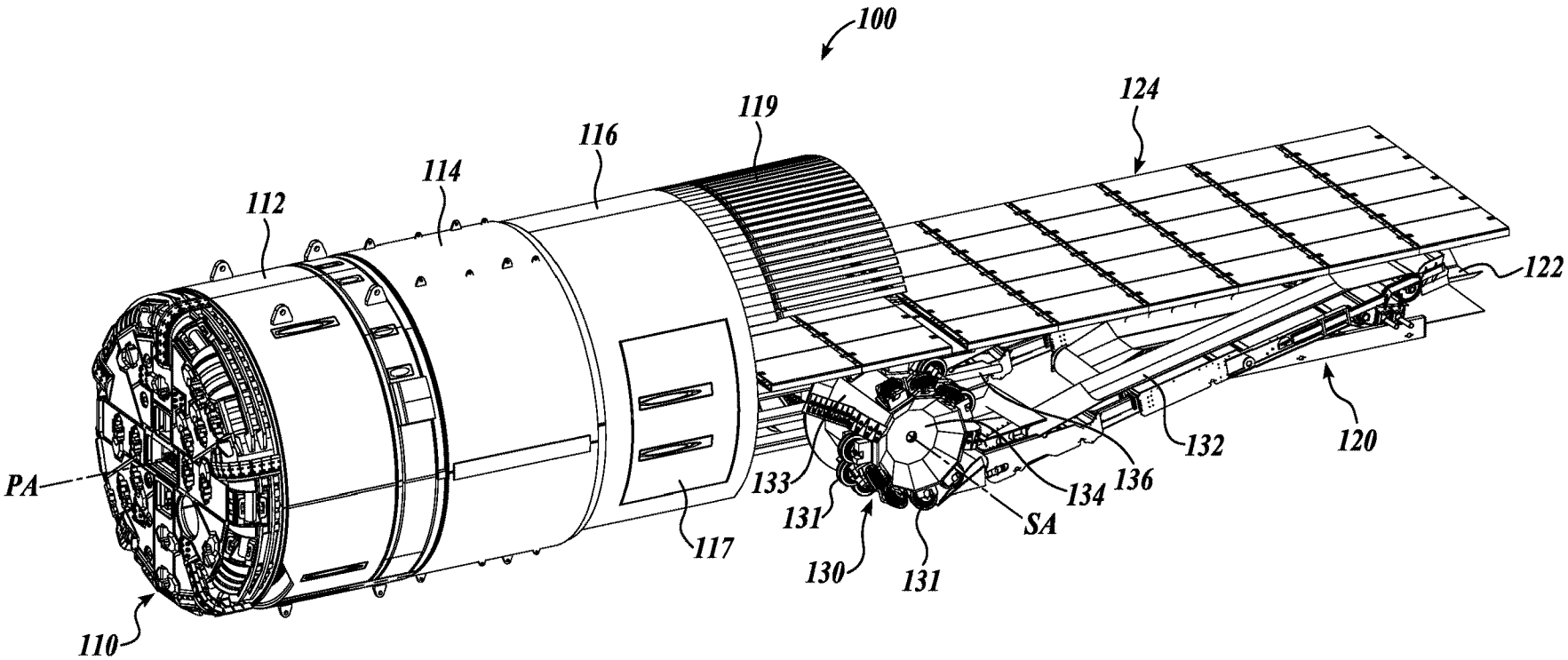
FIGS. 2A and 2B are perspective views of the TBM of FIGS. 1A and 1B, with the representative portion of tunneling substrate hidden to show secondary cutterheads drivably rotatable about a horizontal axis perpendicular to the rotational axis of the main cutterhead.
Figure 2B:
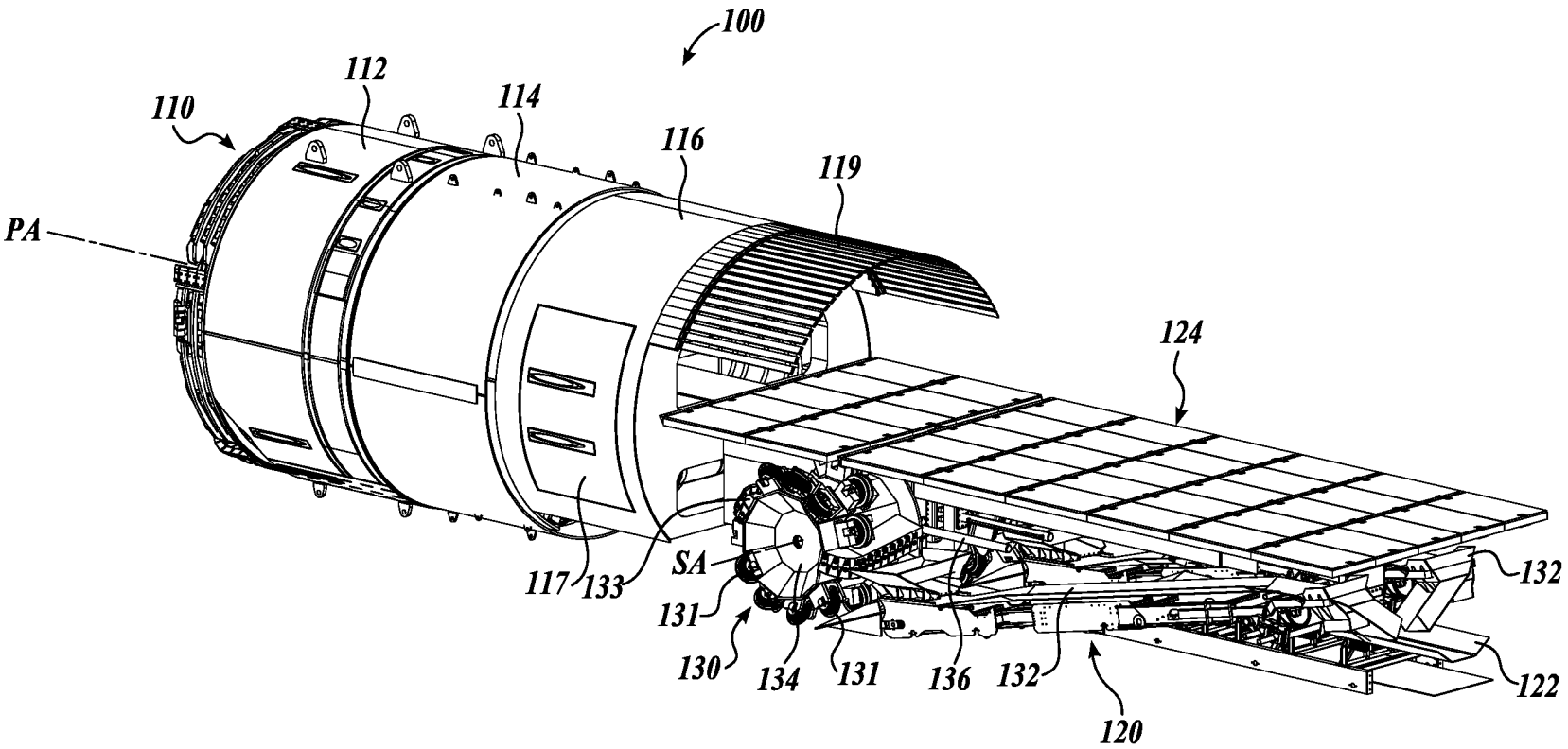
Figure 2C:
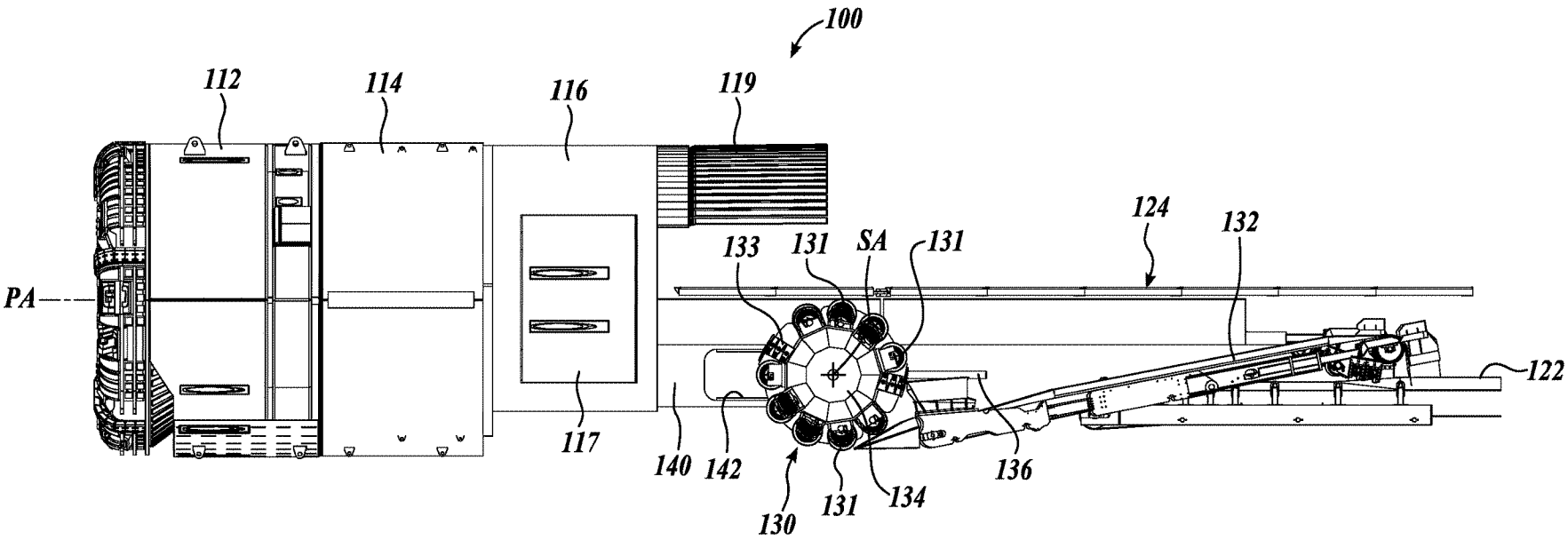
FIGS. 2C-2G are side, top, bottom, front, and rear views, respectively, of the TBM of FIGS. 1A and 1B, with the representative portion of tunneling substrate hidden.
Figure 2D:
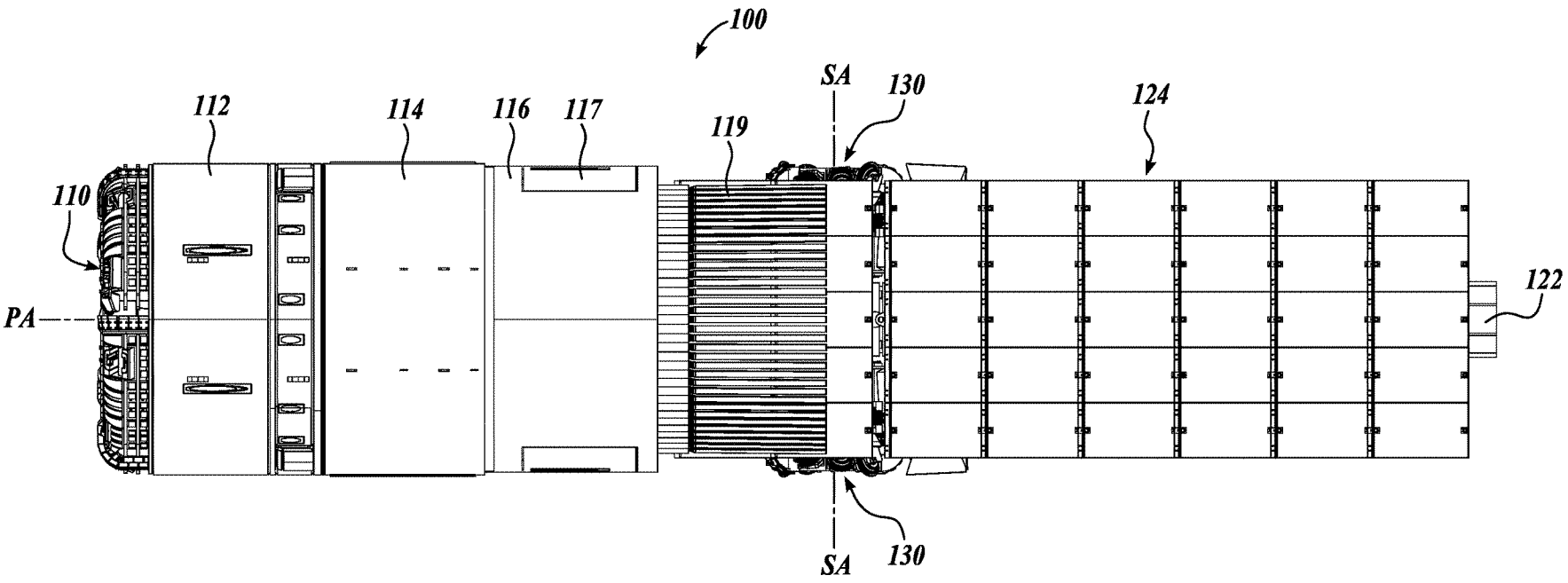
Figure 2E:
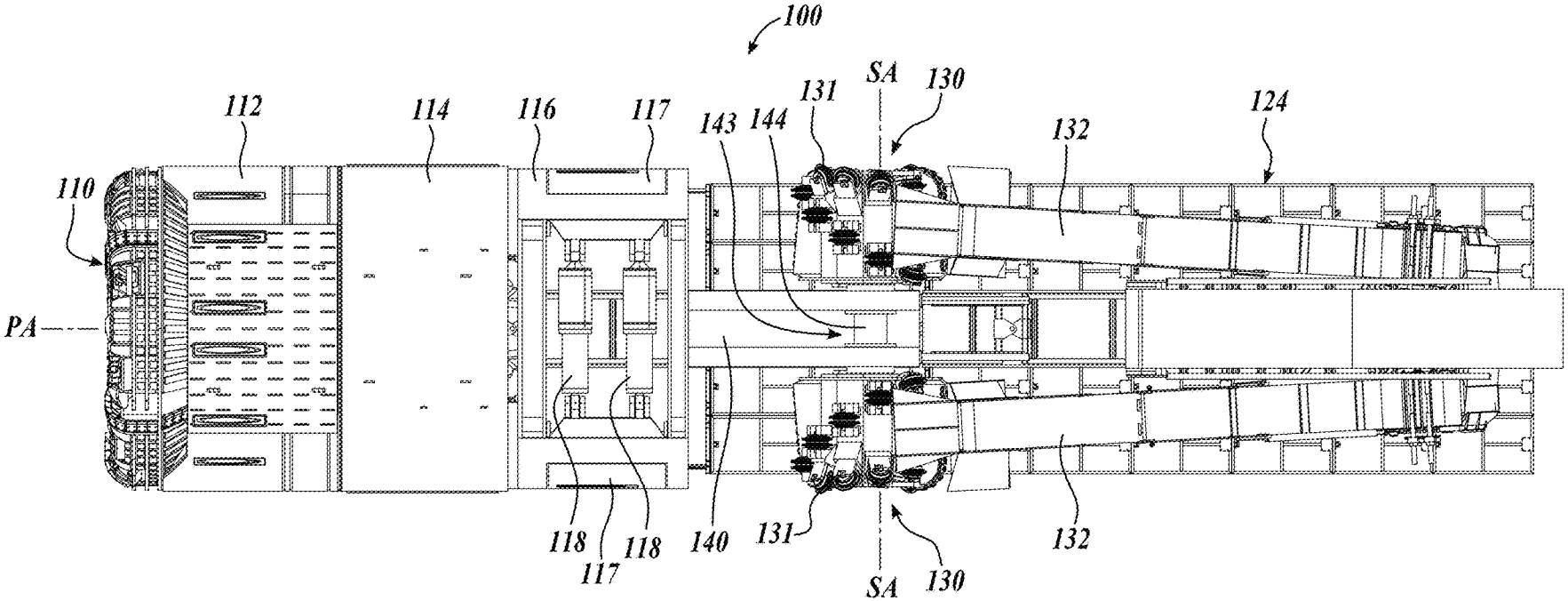
Figure 2G:
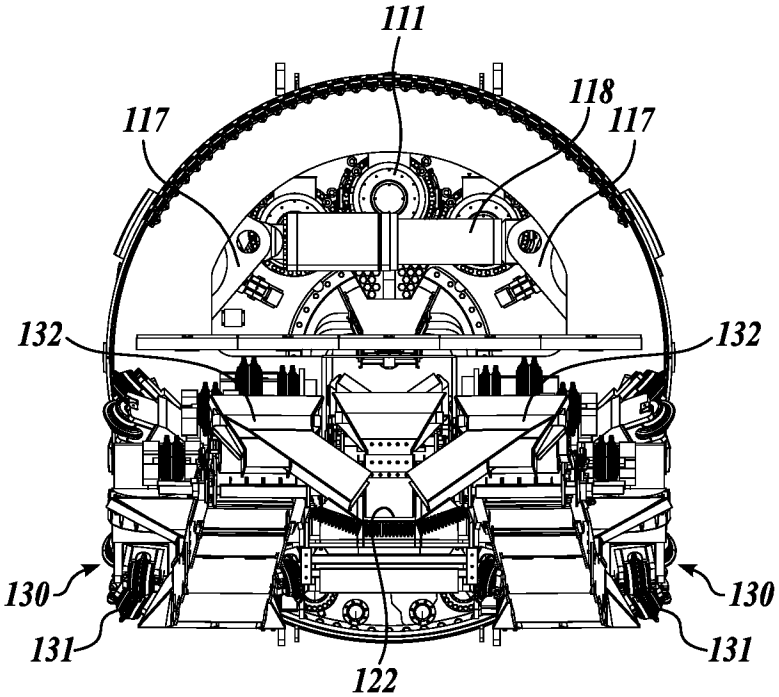
Figure 2F:
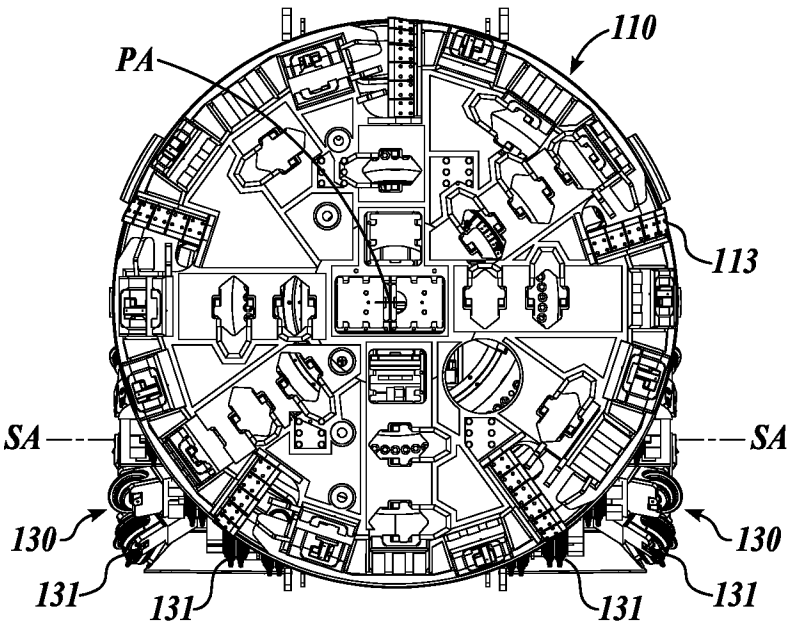

FIGS. 2A and 2B are perspective views and FIGS. 2C-2G, are side, top, bottom, front, and rear views, respectively, of the TBM 100 in accordance with embodiments of the present disclosure. In FIGS. 2A-2G, the tunneling substrate SUB is hidden to show secondary cutterhead assemblies 130 drivably rotatable about a horizontal secondary axis SA that is perpendicular to the rotational primary axis PA of the main cutterhead 110 that is rotated by a main drive 111 (FIG. 2G). The TBM 100 can include a forward shield 112 (a "cutterhead support"), a telescopic shield 114 located behind the forward shield 112, a gripper shield 116 having gripper shoes 117 located behind the telescopic shield 114, protective finger shield 119, and a ground support install area/work platform area 124 behind the gripper shield 116 and partially under the finger shield 119. The forward shield 112 can include various components to support and drive rotation of the cutterhead, such as a cutterhead support structure, the main drives, etc. The TBM 100 can include various components (not shown) behind the work platform area 124, including an operator's cab, a VFD cabinet, one or more transformers, drills, heat exchangers, cooling tanks, water tanks, hydraulic reservoirs, cable reels, a lube power unit, tow equipment, crawlers, and other components of the TBM 100. The conveyor system 120 can include a primary belt conveyor system, typically located along a center plane of the TBM, which delivers the cuttings ("muck") removed by the main cutterhead 110 to a backup conveyor 122, which transports the muck rearwardly for removal from the tunnel.

The secondary cutterhead assemblies 130 are installed behind the gripper shield 116 via carriers 134 that slide in the fore and aft direction within a slot 142 on a main/central beam 140 ("main support beam 140," see FIGS. 2C and 2E) that is securely connected to the gripper shield 116 and gripper shoes 117. The secondary cutterhead assemblies 130 are propelled forward by a set of thrust cylinders 136 between the carriers 134 and the main support beam 140. The carriers 134 of the secondary cutterhead assemblies 130 can be rotatably coupled together by an axle 144 (FIG. 2E) extending through the slots 142, or can be independently rotatable with respect to one another. In some embodiments, the secondary cutterhead assemblies 130 are configured to rotate on the axle 144 about the secondary axis SA that is perpendicular in the horizontal plane to the primary axis PA (aligned with the tunnel axis). Each secondary cutterhead assembly 130 can be rotated by a drive system 143 having the single drive axle 144 or a pair of drive axles operably coupled to the carriers 134. Each of the secondary cutterhead assemblies 130 includes a plurality of disc cutters 131 and one or more muck buckets 133. Peripheral conveyors 132 are mounted adjacent to the secondary cutterhead assemblies 130 and are configured to collect excavated muck dumped from the muck buckets 133 and deliver the muck to the primary belt conveyor system 120 at a common dump station above the backup conveyor 122. In further embodiments, a TBM gripper system, or an independent gripping system (not shown) stabilizes the main support beam 140 against the ground during operation.

Example Operation of the 12% TBM

At the start of a boring cycle, the gripper shoes 117 are extended against side walls of the tunnel T by gripper shoe extension cylinders 118 (FIGS. 2E and 2G), and are configured impart the TBM's forward thrust. Hydraulic thrust cylinders of the gripper shield 116 extend, pushing the cutters of the main cutterhead 110 into the rock face and reacting to the boring forces. The transfer of this high thrust through the rolling disc cutters of the main cutterhead 110 creates fractures in the rock, causing chips to break away from the tunnel face, creating the circular tunnel as shown in the main cutterhead boring area of FIG. 3. The gripper shield 116 having the gripper shoes 117 pushes on the sidewalls and is locked in place while the thrust cylinders of the gripper shield 116 extend, allowing the main support beam 140 to be stationary while the TBM 100 advances through the tunnel T and create the circular area. In addition, the configuration of the machine allows continuous ground support to be placed immediately behind the gripper shields 116, or optionally the finder shield 119, if included, and above the tunnel centerline in the semicircular-arched crown AC of the tunnel T. Various ground support and installation of utilities, such as piping, ventilation, and lighting are done simultaneously to boring the tunnel and adjacent to and/or directly behind the secondary cutterhead assemblies 130. Because the rock is mechanically fractured, no secondary crushing is required, and the broken rock is well suited for conveyor haulage.

A unique aspect of the disclosed TBM 100 in accordance with embodiments of the present disclosure is included in the orientation and shape of the secondary cutterhead assemblies 130 operating behind the main cutterhead 110. The secondary cutterhead assemblies 130 can use an independent gripping system or can be tied to the TBM's main gripper system (e.g., the gripper shoes 117 of the gripper shield 116), or can include a secondary gripper system intended to permit the secondary cutterhead assemblies 130 to impart pressure on the secondary cutterhead boring area shown in FIG. 3 to create the flat bottom FB area of the tunnel T. In either configuration, the secondary cutterhead assemblies 130 can utilize the thrust cylinders 136, which permit simultaneous operation independently from the advancing system (the forward shield 112 of the main cutterhead 110) for improved control of the operation of the TBM 100. Rotation of the secondary cutterhead assemblies 130 by the axle 144 may be concurrent with the main drive 111 from the main cutterhead 110, or the rotation can be individually controlled. In embodiments with individual control of the rotation of the secondary cutterhead assemblies 130, operation can be configured to have the same penetration rate as the main cutterhead 110. The orientation and shape of the secondary cutterhead assemblies 130 allow for efficient rock cutting by allowing the cutters 131 to always follow in the same cutting path. The direction of rotation of the secondary cutterhead assemblies 130 also allows the cutters to enter the rock starting with no penetration and then reaching maximum penetration in the direction of boring, further increase efficiency.

Figure 3:
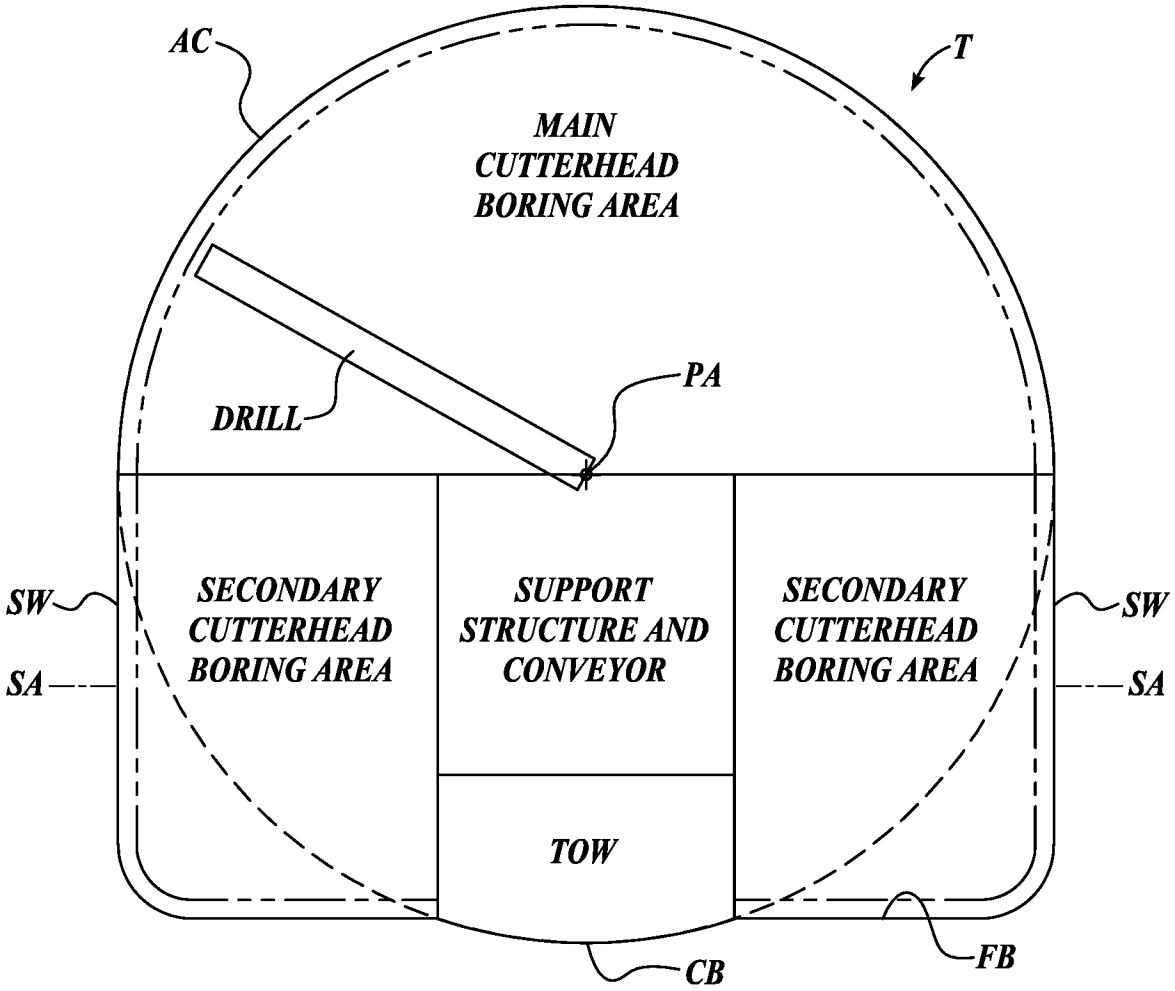
FIG. 3 is a schematic tunnel view of a representative tunnel having a semicircular shape formed by a TBM of the present disclosure.

As shown in FIG. 3, the circular main cutterhead boring area is initially created by the main cutterhead 110, providing the majority (approximately 88%) of the tunnel T, including the semicircular-arched crown AC. As indicated in FIG. 3, the support structure and conveyor, and the tow equipment (crawlers, tracks, etc.) travel through the main cutterhead boring area during use of the TBM 100. The secondary cutterhead boring areas are then created by the secondary cutterhead assemblies 130 providing the remaining minority (approximately 12%) of the tunnel T, including the vertical sidewalls SW and the flat bottom FB area. As shown, in some embodiments a small amount of the main cutterhead boring area can extend lower into the tunneling substrate than the secondary cutterhead boring areas, which can create a slight curved bottom CB area in the middle of the bottom of the tunnel. This area can be filled with concrete or other material, or can be straddled by the standard vehicle equipment (e.g., with a wheel on either side) or in larger tunnels, the standard vehicles can travel on either side of the curved bottom CB area on the flat bottom FB area.

Embodiments of the 12% TBM 100 can further include a muck removal system having unique aspects compared to conventional TBMs. In embodiments of the present disclosure, muck from the main cutterhead 110 is deposited via muck buckets 113 through a rotating action onto a belt conveyor inside TBM 100 and the main support beam 140 and includes an independent muck removal configuration in the peripheral conveyors 132. As the secondary cutterhead assemblies 130 excavate the final 12% of the tunnel, the muck buckets 133 (FIGS. 2A-2C) rotate and pick up the material, depositing it onto the peripheral belt conveyors 132 located on either side of the main support beam 140. These belt conveyors 132 transfer muck to the backup conveyor 122 to exit the tunnel. The integration of the muck from the secondary cutterhead assemblies 130 with the muck from the main cutterhead 110 is advantageous, as all the muck can be continuously removed through the TBM 100 with the same conveyor system 120.

The secondary cutterhead assemblies 130 can also be utilized during demobilization of the TBM 100, which is a critical aspect for many tunnel boring projects. In one embodiment, the secondary cutterhead assemblies 130 are configured to be modified by installing a rigid mounting system around the plurality of cutters 131, or by removing the secondary cutterhead assemblies 130 and replacing them with, e.g., a wheel track system, etc., to provide mobility for the entire TBM 100. The heavy load capacities of the secondary cutterhead assemblies 130 and axle 144 required for rock cutting, along with the independent control of the cutting rotation, allow the cutting wheels 134 to function as a wheel drive system allowing the machine to be driven out of the tunnel.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 10% of the stated value. For the purposes of the present disclosure, the phrase "at least one of A and B" is equivalent to "A and/or B" or vice versa, namely "A" alone, "B" alone or "A and B." Similarly, the phrase "at least one of A, B, and C," for example, means (A), (B), (C), (A and B), (A and C), (B and C), or (A, B, and C), including all further possible permutations when greater than three elements are listed.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A tunnel boring machine for boring a semicircular-arched tunnel having a tunnel wall, the tunnel boring machine comprising:

a main support beam;

a main cutterhead assembly rotatably coupled to a front end of a cutterhead support slidable with respect to the main support beam, wherein the main cutterhead assembly is configured to rotate with respect to the cutterhead support about a primary axis that is aligned with a centerline of a semicircular portion of the tunnel;

a plurality of gripper assemblies located rearward of the main cutterhead assembly, the gripper assemblies being configured to move between:

a retracted position in which the gripper assemblies do not engage the tunnel wall; and an extended position wherein the gripper assemblies engage the tunnel wall to impart axial movement to the main cutterhead assembly and to react to boring forces of the tunnel boring machine;

a pair of secondary cutterhead assemblies slidably mounted to and disposed on opposite sides of the main support beam, wherein each of the pair of secondary cutterhead assemblies has a carrier operably coupled to a drive system configured to rotate the secondary cutterhead assemblies about a secondary axis perpendicular to the primary axis; and at least one thrust cylinder configured to urge the pair of secondary cutterhead assemblies forwardly with respect to the main support beam independently of the main cutterhead assembly, wherein the drive system comprises a drive axle assembly extending between the carriers of the pair of secondary cutterhead assemblies, wherein the drive axle assembly is a split axle such that each of the pair of secondary cutterhead assemblies has independent drive with respect to the other of the pair of secondary cutterhead assemblies.

2. The tunnel boring machine of claim 1, wherein the main support beam is elongated along the primary axis and has an upper portion extending along the primary axis and a lower portion having an elongate slot, wherein the pair of secondary cutterhead assemblies engage the elongate slot to permit the secondary cutterhead assemblies to move longitudinally with respect to the main support beam.

3. The tunnel boring machine of claim 2, wherein the elongate slots are parallel to the primary axis, and wherein the secondary axis is horizontal.

4. The tunnel boring machine of claim 1, wherein the secondary cutterhead assemblies are disposed on the main support beam rearward of the plurality of gripper assemblies.

5. The tunnel boring machine of claim 1, further comprising:

a forward shield adjacent to the main cutterhead assembly;

a telescopic shield located rearward of the forward shield, wherein the telescopic shield is configured to extend and retract in combination with translation of the main cutterhead assembly along the primary axis; and a gripper shield located rearward of the telescopic shield and adjacent to the plurality of gripper assemblies.

6. The tunnel boring machine of claim 1, further comprising a backup conveyor configured to collect primary muck created by the main cutterhead assembly during use and transport the primary muck rearwardly for removal from the tunnel.

7. The tunnel boring machine of claim 6, further comprising a pair of peripheral conveyors each mounted adjacent to one of the pair of secondary cutterhead assemblies, wherein the peripheral conveyors are configured to collect secondary muck created by the secondary cutterhead assemblies during use and deliver the secondary muck to a common dump station above the backup conveyor such that the secondary muck combines with the primary muck for removal from the tunnel.

8. The tunnel boring machine of claim 7, wherein the pair of secondary cutterhead assemblies each include a muck bucket operably coupled to each carrier and rotatable by the drive system, wherein the muck buckets are configured to collect the secondary muck and deliver the secondary muck to the peripheral conveyors.

9. The tunnel boring machine of claim 1, wherein the secondary cutterhead assemblies are configured to carry a portion of the weight of the tunnel boring machine for decommissioning and removal from the tunnel.

10. A method of boring a tunnel having a semicircular-arched profile with a tunnel boring machine according to claim 1, the method comprising:

positioning the gripper assemblies in the extended position wherein the gripper assemblies engage the tunnel wall to impart axial movement to the main cutterhead assembly and to react to boring forces of the tunnel boring machine;

excavating a circular main cutterhead boring area of the tunnel by rotating and simultaneously thrusting the main cutterhead assembly into a tunneling substrate;

collecting primary muck created by the main cutterhead assembly during excavation and transporting the primary muck rearward with a backup conveyor extending along the main support beam; and excavating lower side portions of the tunnel by rotating and simultaneously thrusting the secondary cutterhead assemblies into the tunneling substrate.

11. The method of claim 10, further comprising collecting secondary muck created by the secondary cutterhead assemblies during excavation and transporting the secondary muck rearward with peripheral conveyors positioned adjacent to the secondary cutterhead assemblies.

12. The method of claim 11, further comprising depositing the secondary muck on the peripheral conveyors, wherein the peripheral conveyors are configured to convey the secondary muck to a common dump station above the backup conveyor such that the secondary muck combines with the primary muck for removal from the tunnel.

13. The method of claim 10, wherein the secondary cutterhead assemblies create secondary cutterhead boring areas that have substantially vertical sidewalls and flat bottom portions.

14. The method of claim 13, wherein the tunnel has a curved bottom portion created by the excavation of the circular main cutterhead boring area and positioned between the flat bottom portions created by the excavation of the secondary cutterhead boring areas.

15. The method of claim 10, wherein the excavation of the lower side portions of the tunnel is performed simultaneous to or independent from the excavation of the circular main cutterhead boring area.

16. A method of boring a tunnel having a semicircular-arched profile, the method comprising:

providing a tunnel boring machine, having:

a main support beam;

a main cutterhead assembly rotatably coupled to a front end of a cutterhead support slidable with respect to the main support beam, wherein the main cutterhead assembly is configured to rotate with respect to the cutterhead support about a primary axis that is aligned with a centerline of a semicircular portion of the tunnel;

a plurality of gripper assemblies located rearward of the main cutterhead assembly, the gripper assemblies being configured to selectively impart axial movement to the main cutterhead assembly;

a pair of secondary cutterhead assemblies slidably mounted to and disposed on opposite sides of the main support beam, wherein each of the pair of secondary cutterhead assemblies is operably coupled to a drive system configured to rotate the secondary cutterhead assemblies about a secondary axis perpendicular to the primary axis; and at least one thrust cylinder configured to urge the pair of secondary cutterhead assemblies forwardly with respect to the main support beam independently of the main cutterhead assembly;

positioning the gripper assemblies in an extended position wherein the gripper assemblies engage a tunnel wall of the tunnel to impart axial movement to the main cutterhead assembly and to react to boring forces of the tunnel boring machine;

excavating a circular main cutterhead boring area of the tunnel by rotating and simultaneously thrusting the main cutterhead assembly into a tunneling substrate;

excavating lower side portions of the tunnel by rotating and simultaneously thrusting the secondary cutterhead assemblies into the tunneling substrate;

collecting primary muck created by the main cutterhead assembly during excavation and transporting the primary muck rearward with a backup conveyor extending along the main support beam;

collecting secondary muck created by the secondary cutterhead assemblies during excavation and transporting the secondary muck rearward with peripheral conveyors positioned adjacent to the secondary cutterhead assemblies; and depositing the secondary muck on the peripheral conveyors to a common dump station above the backup conveyor such that the secondary muck combines with the primary muck for removal from the tunnel.

17. The method of claim 16, wherein the secondary cutterhead assemblies create secondary cutterhead boring areas that have substantially vertical sidewalls and flat bottom portions.

18. The method of claim 16, wherein the main support beam is elongated along the primary axis and has an upper portion extending along the primary axis and a lower portion having an elongate slot, wherein the pair of secondary cutterhead assemblies engage the elongate slot to permit the secondary cutterhead assemblies to move longitudinally with respect to the main support beam.

19. A tunnel boring machine for boring a semicircular-arched tunnel having a tunnel wall, the tunnel boring machine comprising:

a main support beam;

a main cutterhead assembly rotatably coupled to a front end of a cutterhead support slidable with respect to the main support beam, wherein the main cutterhead assembly is configured to rotate with respect to the cutterhead support about a primary axis that is aligned with a centerline of a semicircular portion of the tunnel;

a plurality of gripper assemblies located rearward of the main cutterhead assembly, the gripper assemblies being configured to move between:

a retracted position in which the gripper assemblies do not engage the tunnel wall; and an extended position wherein the gripper assemblies engage the tunnel wall to impart axial movement to the main cutterhead assembly and to react to boring forces of the tunnel boring machine;

a pair of secondary cutterhead assemblies slidably mounted to and disposed on opposite sides of the main support beam, wherein each of the pair of secondary cutterhead assemblies has a carrier operably coupled to a drive system configured to rotate the secondary cutterhead assemblies about a secondary axis perpendicular to the primary axis;

at least one thrust cylinder configured to urge the pair of secondary cutterhead assemblies forwardly with respect to the main support beam independently of the main cutterhead assembly;

a backup conveyor configured to collect primary muck created by the main cutterhead assembly during use and transport the primary muck rearwardly for removal from the tunnel; and a pair of peripheral conveyors each mounted adjacent to one of the pair of secondary cutterhead assemblies, wherein the peripheral conveyors are configured to collect secondary muck created by the secondary cutterhead assemblies during use and deliver the secondary muck to a common dump station above the backup conveyor such that the secondary muck combines with the primary muck for removal from the tunnel.

20. A method of boring a tunnel having a semicircular-arched profile with a tunnel boring machine, having:

a main support beam;

a main cutterhead assembly rotatably coupled to a front end of a cutterhead support slidable with respect to the main support beam, wherein the main cutterhead assembly is configured to rotate with respect to the cutterhead support about a primary axis that is aligned with a centerline of a semicircular portion of the tunnel;

a plurality of gripper assemblies located rearward of the main cutterhead assembly, the gripper assemblies being configured to move between:

a retracted position in which the gripper assemblies do not engage a tunnel wall of the tunnel; and an extended position wherein the gripper assemblies engage the tunnel wall to impart axial movement to the main cutterhead assembly and to react to boring forces of the tunnel boring machine;

a pair of secondary cutterhead assemblies slidably mounted to and disposed on opposite sides of the main support beam, wherein each of the pair of secondary cutterhead assemblies has a carrier operably coupled to a drive system configured to rotate the secondary cutterhead assemblies about a secondary axis perpendicular to the primary axis; and at least one thrust cylinder configured to urge the pair of secondary cutterhead assemblies forwardly with respect to the main support beam independently of the main cutterhead assembly, the method comprising:

positioning the gripper assemblies in the extended position wherein the gripper assemblies engage the tunnel wall to impart axial movement to the main cutterhead assembly and to react to boring forces of the tunnel boring machine;

excavating a circular main cutterhead boring area of the tunnel by rotating and simultaneously thrusting the main cutterhead assembly into a tunneling substrate;

collecting primary muck created by the main cutterhead assembly during excavation and transporting the primary muck rearward with a backup conveyor extending along the main support beam;

excavating lower side portions of the tunnel by rotating and simultaneously thrusting the secondary cutterhead assemblies into the tunneling substrate;

collecting secondary muck created by the secondary cutterhead assemblies during excavation and transporting the secondary muck rearward with peripheral conveyors positioned adjacent to the secondary cutterhead assemblies; and depositing the secondary muck on the peripheral conveyors, wherein the peripheral conveyors are configured to convey the secondary muck to a common dump station above the backup conveyor such that the secondary muck combines with the primary muck for removal from the tunnel.

* * * * *